US008368489B2

(12) United States Patent
Sohn

(10) Patent No.: US 8,368,489 B2
(45) Date of Patent: Feb. 5, 2013

(54) CIRCUIT BREAKER HAVING TRIP CAUSE INDICATING MECHANISM

(75) Inventor: Jong Mahn Sohn, Chungcheongbuk-Do (KR)

(73) Assignee: LS Industrial Systems Co., Ltd., Anyang, Gyeonggi-Do (KR)

( * ) Notice: Subject to any disclaimer, the term of this patent is extended or adjusted under 35 U.S.C. 154(b) by 32 days.

(21) Appl. No.: 13/013,745

(22) Filed: Jan. 25, 2011

(65) Prior Publication Data

US 2011/0181379 A1 Jul. 28, 2011

(30) Foreign Application Priority Data

Jan. 27, 2010 (KR) ..... 10-2010-0007586

(51) Int. Cl.
*H01H 77/00* (2006.01)
*H01H 83/00* (2006.01)
*H01H 73/12* (2006.01)

(52) U.S. Cl. ..... 335/17; 335/78; 335/128

(58) Field of Classification Search ..... 335/2, 6, 335/17, 78, 128, 201, 202
See application file for complete search history.

(56) References Cited

U.S. PATENT DOCUMENTS

| | | | | |
|---|---|---|---|---|
| 6,040,746 | A * | 3/2000 | Maloney et al. | 335/13 |
| 6,642,820 | B2 * | 11/2003 | Emura et al. | 335/17 |
| 7,732,723 | B2 * | 6/2010 | Kolmonen et al. | 200/534 |

FOREIGN PATENT DOCUMENTS

| | | |
|---|---|---|
| DE | 102007014174 | 9/2008 |
| EP | 1950784 | 7/2008 |
| EP | 2015337 | 1/2009 |
| EP | 2028677 | 2/2009 |
| JP | 5534341 | 8/1978 |
| JP | 55163740 | 12/1980 |
| JP | 64082429 | 3/1989 |
| JP | 1236536 | 9/1989 |
| JP | 447628 | 2/1992 |
| JP | 5120978 | 5/1993 |
| JP | 6139914 | 5/1994 |
| JP | 6236726 | 8/1994 |
| JP | 6338246 | 12/1994 |
| JP | 2004200168 | 7/2004 |
| JP | 2007220526 | 8/2007 |
| KR | 100903149 | 6/2009 |

* cited by examiner

*Primary Examiner* — Bernard Rojas
(74) *Attorney, Agent, or Firm* — Lee, Hong, Degerman, Kang & Waimey

(57) ABSTRACT

A circuit breaker comprises a magnetic trip mechanism configured to provide a first mechanical driving force, a low voltage trip mechanism configured to provide a second mechanical driving force, a first micro switch configured to generate and output a first trip signal indicating that the circuit breaker has performed a trip operation due to the occurrence of a fault current on a circuit, a second micro switch configured to generate and output a second trip signal indicating that the circuit breaker has performed a trip operation due to the occurrence of a low voltage on the circuit, a first driving force transmission mechanism configured to transmit the first mechanical driving force from the magnetic trip mechanism to the first micro switch, and a second driving force transmission mechanism configured to transmit the second mechanical driving force from the low voltage trip mechanism to the second micro switch.

6 Claims, 12 Drawing Sheets

CIRCUIT BREAKER HAVING TRIP CAUSE INDICATING MECHANISM

CROSS-REFERENCE TO A RELATED APPLICATION

Pursuant to 35 U.S.C. §119(a), this application claims the benefit of earlier filing date and right of priority to Korean Application 10-2010-007586, filed on Jan. 27, 2010, the content of which is incorporated by reference herein in its entirety.

BACKGROUND OF THE DISCLOSURE

1. Field of the Disclosure

The present disclosure relates to a circuit breaker capable of providing information on a trip cause, and more particularly, to a circuit breaker having a trip cause indicating mechanism for providing information on whether a trip cause results from a fault current or an under voltage.

2. Background of the Disclosure

Generally, a circuit breaker is an apparatus for protecting a circuit by opening or closing the circuit between a power side and a load side, or by breaking the circuit in the occurrence of an electrical fault such as a ground fault or an electrical shortage. That is, the circuit breaker converts a status of an electrical circuit to an 'OFF' or 'ON' status by a user's manipulation, and breaks the circuit automatically by trip operation in the occurrence of an overload or an electrical shortage, thereby protecting load side components and the circuit. In the conventional circuit breaker, when the trip operation is performed due to a fault current, a trip indicating contact switch for providing trip information to a manager of an electrical facility or a user is operated.

The conventional trip status indicating mechanism for a circuit breaker will be explained with reference to FIGS. 1 and 2.

FIG. 1 is a view showing that a trip indicating contact switch of a circuit breaker is not operated in accordance with the conventional art, and FIG. 2 is a view showing that a trip indicating contact switch of a circuit breaker is operated in accordance with the conventional art.

The conventional trip indicating contact switch of a circuit breaker comprises a trip indicating switch 1, a driving force transmission lever 2, a magnetic trip mechanism 3. Reference numeral 4 in FIGS. 1 and 2 denotes a switch driving lever 4 configured to operate the trip indicating switch 1 to an 'ON' or 'OFF' position.

The operation of the conventional trip indicating contact switch of a circuit breaker will be explained as follows.

In an electric power user such as a factory, a transformer is installed as an electricity receiving apparatus, and a large capacity circuit breaker such as an air circuit breaker is installed to connect with an output of the transformer. This large capacity circuit breaker comprises a controller called as 'Over Load Relay' or 'Over Current Relay' (which is abbreviated as OCR hereinafter). The OCR detects a fault of a current which flows on a circuit by being electrically connected to the circuit, such as an electrical shortage, an over current or a ground fault. Then, the OCR outputs a trip command signal to a trip mechanism when a fault has been detected. In response to the trip command signal, the trip mechanism triggers a switching mechanism for a trip operation.

Upon receiving a corresponding trip command signal transmitted from the OCR, the magnetic trip mechanism 3 triggers the switching mechanism so as to break a circuit. As a movable contact (not shown) is separated from a fixed contact, a trip operation is completed. Here, the driving force transmission lever 2 forwardly rotates by interlocking with components which move to a front side of the magnetic trip mechanism 3, thereby pushing a switch operation lever 6 of the trip indicating switch 1. As a result, the trip indicating switch 1 as a micro switch outputs a trip indicating signal. When the circuit breaker is reset after being tripped, the trip indicating switch 1 rotates to an initial position by a return spring (not shown). At the same time, the trip indicating switch 1 is also initialized to stop outputting a trip indicating signal.

The conventional circuit breaker may have a trip operation due to a low voltage on the circuit (hereinafter, will be referred to as 'Under Voltage Trip'), as well as a fault current such as an electrical shortage. However, the conventional circuit breaker is configured to output a trip indicating signal only when a trip operation occurs due to a fault current. Accordingly, it is difficult to check whether a trip operation has occurred due to a fault current or an under voltage.

In the event of an under voltage trip, a remote monitoring center or a central monitoring and supervising equipment could not recognize the under voltage trip. Accordingly, it was difficult to recognize a cause of a trip occurrence, and to determine a re-closing command for the circuit breaker after the trip occurrence.

SUMMARY OF THE DISCLOSURE

Therefore, an object of the present disclosure is to provide a circuit breaker capable of outputting a trip indicating signal according to a trip cause such that a user easily recognizes whether a trip operation has occurred due to a fault current such as an electrical shortage or a low voltage on a circuit.

To achieve these and other advantages and in accordance with the purpose of the present disclosure, as embodied and broadly described herein, there is provided a circuit breaker having a switching mechanism having an 'OFF' position for manually breaking a circuit, an 'ON' position for manually closing the circuit, and a 'TRIP' position for automatically breaking the circuit, the circuit breaker comprising: an over current relay configured to generate and output a first trip control signal when an abnormal current on the circuit has been detected, and to generate and output a second trip control signal when a voltage applied to the circuit has been detected as a voltage less than a predetermined reference voltage;

a magnetic trip mechanism electrically connected to the over current relay, and configured to provide a first mechanical driving force when receiving the first trip control signal from the over current relay;

a low voltage trip mechanism electrically connected to the over current relay, and configured to provide a second mechanical driving force when receiving the second trip control signal from the over current relay;

a first micro switch configured to generate and output a first trip indicating signal indicating that the circuit breaker has performed a trip operation due to the occurrence of an abnormal current on the circuit, by converting the first mechanical driving force received from the magnetic trip mechanism into an electric signal;

a second micro switch configured to generate and output a second trip indicating signal indicating that the circuit breaker has performed a trip operation due to the occurrence of a low voltage on the circuit, by converting the second mechanical driving force received from the low voltage trip mechanism into an electric signal;

a first driving force transmission mechanism connected between the first micro switch and the magnetic trip mechanism, and configured to transmit the first mechanical driving force from the magnetic trip mechanism to the first micro switch; and a second driving force transmission mechanism connected between the second micro switch and the low voltage trip mechanism, and configured to transmit the second mechanical driving force from the low voltage trip mechanism to the second micro switch.

The foregoing and other objects, features, aspects and advantages of the present disclosure will become more apparent from the following detailed description of the present disclosure when taken in conjunction with the accompanying drawings.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure.

In the drawings.

DETAILED DESCRIPTION OF THE DISCLOSURE

Description will now be given in detail of the present disclosure, with reference to the accompanying drawings.

For the sake of brief description with reference to the drawings, the same or equivalent components will be provided with the same reference numbers, and description thereof will not be repeated.

Hereinafter, a circuit breaker according to the present invention will be explained in more detail with reference to the attached drawings.

Figure 1:
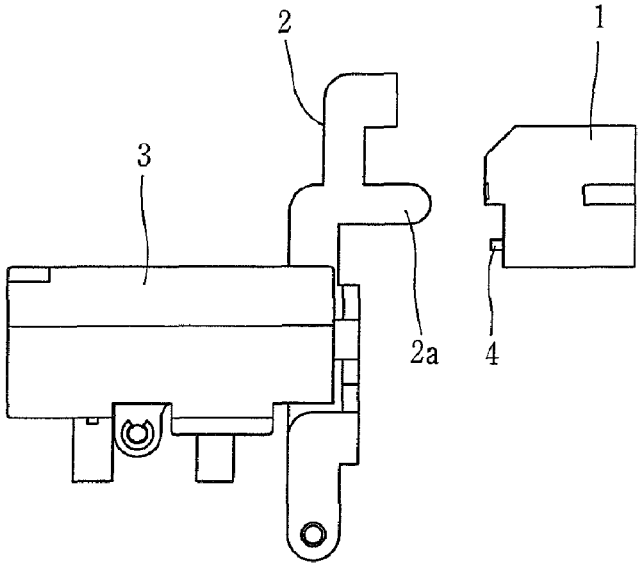
FIG. 1 RELATED ART
FIG. 1 is a side view of a trip indicating signal generator of a circuit breaker in accordance with the conventional art, which shows a state before the trip indicating signal generator is operated.
Figure 2:
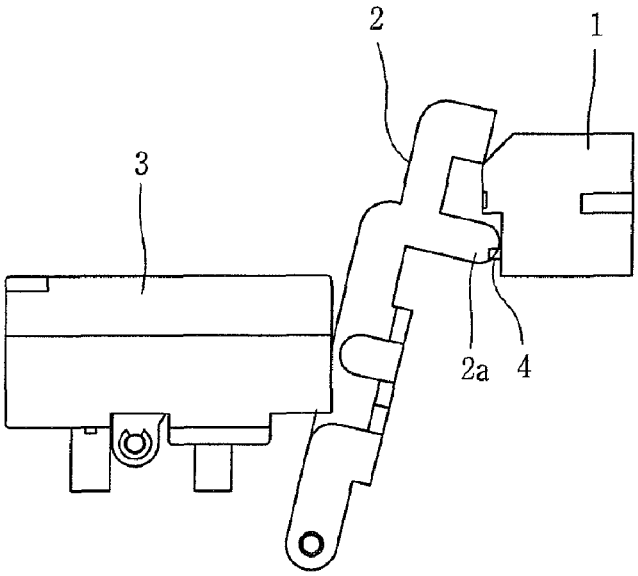
FIG. 2 RELATED ART
FIG. 2 is a side view of the trip indicating signal generator of FIG. 1, which shows a state that the trip indicating signal generator is being operated.
Figure 3:
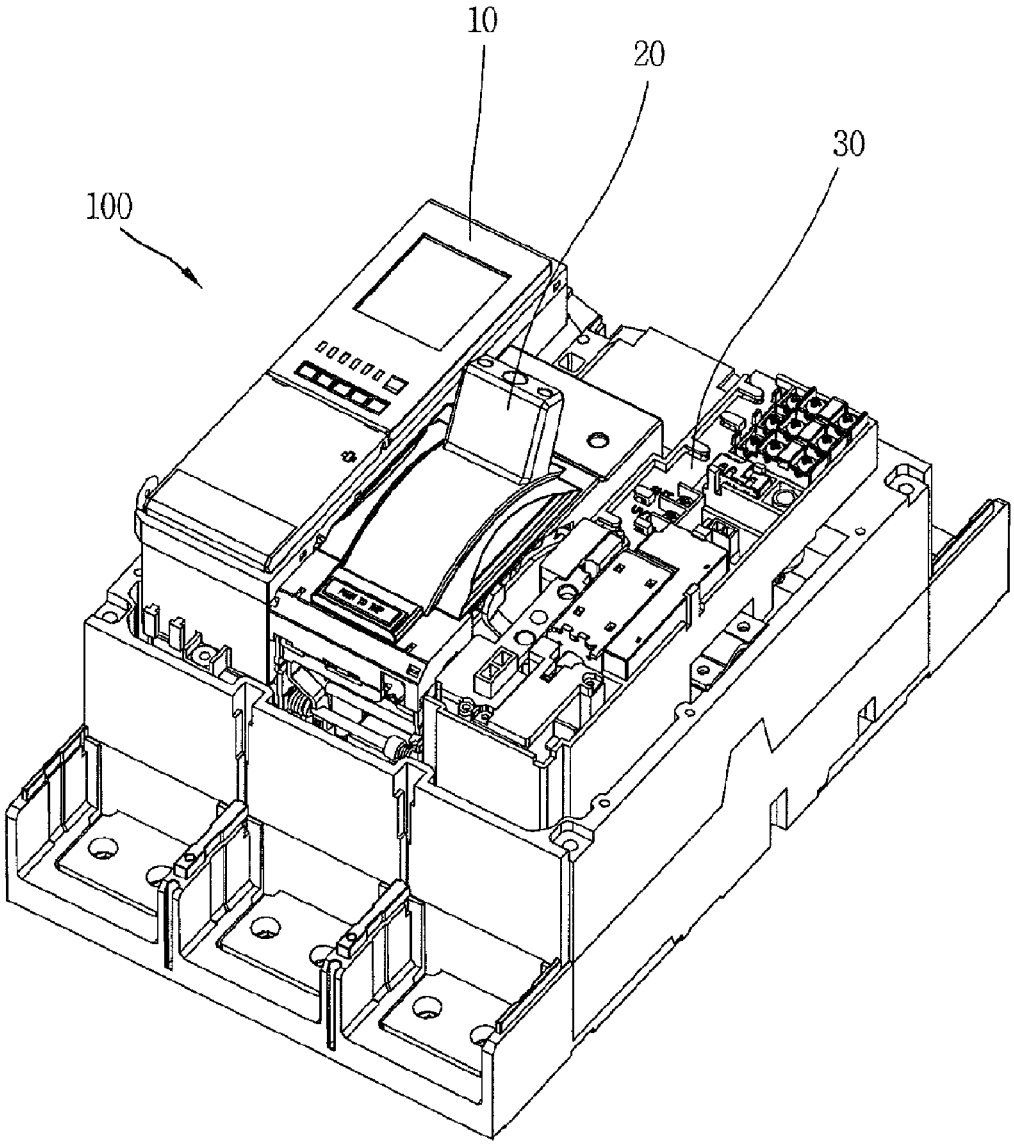
FIG. 3 is a perspective view which shows a external shape of a circuit breaker according to the present invention.

Referring to FIG. 3, the circuit breaker according to the present invention comprises an over current relay (abbreviated as OCR hereinafter) 10, a switching mechanism 20 and a trip cause indicating mechanism 30.

The OCR 10 is a controller of the circuit breaker according to the present invention. And, the OCR 10 is configured to generate and output a first trip control signal when a fault current such as an electrical shortage or an over current has been detected on a circuit, and to generate and output a second trip control signal when a voltage applied to the circuit has been detected as a voltage less than a predetermined reference voltage. Whether a current flowing on the circuit is normal or abnormal may be determined by comparing a current value obtained by a detection unit such as a current transformer with a predetermined reference value with respect to an over current or an electrical shortage. Whether a voltage applied to the circuit has reached are predetermined reference value or not may be determined by comparing a voltage value obtained by a detection unit such as a potential transformer with a predetermined reference value with respect to a low voltage. In order to implement the above functions, the OCR 10 may comprise a micro processor and an electronic device such as an analogue-digital converter.

The switching mechanism 20 has an 'OFF' position for manually breaking a circuit, an 'ON' position for manually closing the circuit, and a 'TRIP' position for automatically breaking the circuit. As well-known, the switching mechanism 20 comprises a handle configured to provide manual operating means to user for an 'OFF' or 'ON' position, a trip spring configured to provide a trip driving force, a link configured to transfer the trip driving force of the trip spring, a rotor rotated by being connected to the link and configured to support a movable contact, a latch configured to restrict or release the trip spring such that the trip spring maintains a charged status or discharges an elastic energy, respectively, and a latch holder configured to restrict or release the latch.

Figure 4:
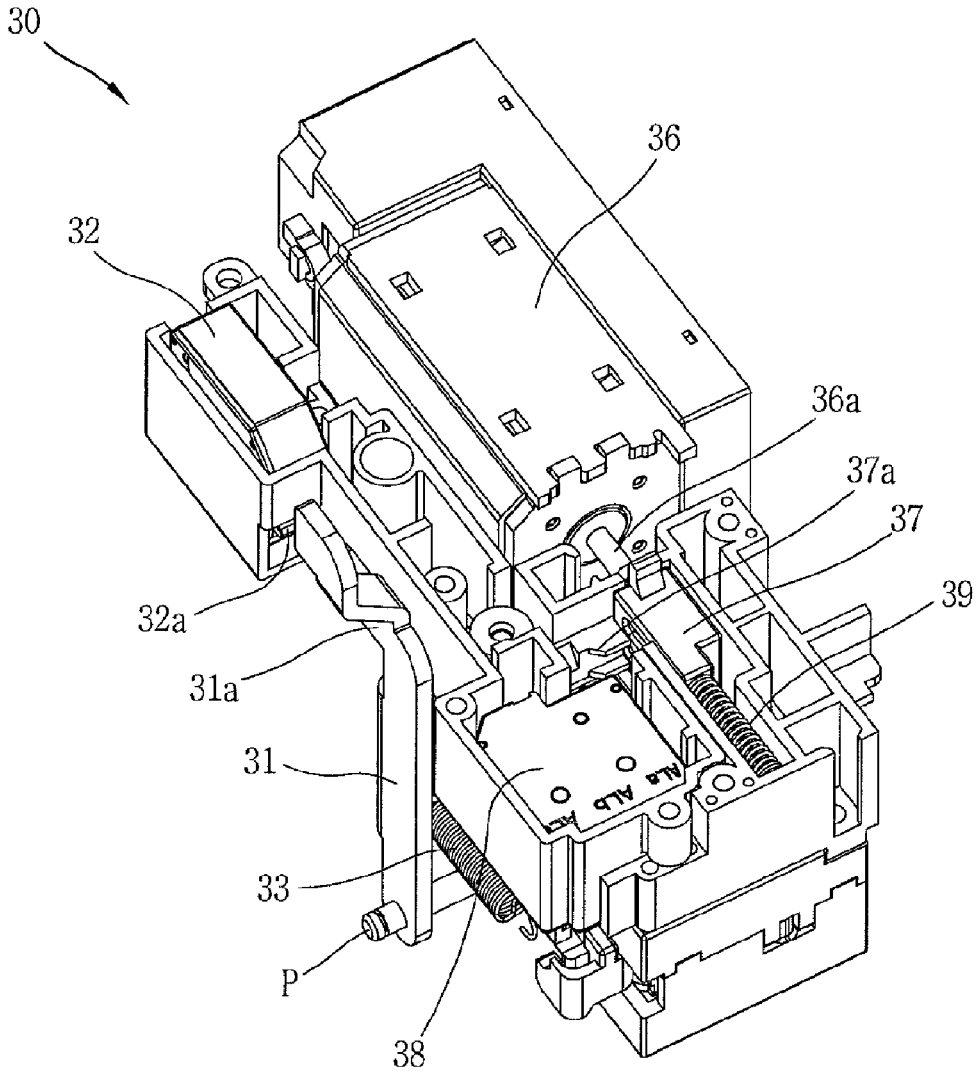
FIG. 4 is a perspective view of a trip cause indicating mechanism of the circuit breaker according to the present invention.

As shown in FIGS. 4 to 12, especially in FIG. 4, the trip cause indicating mechanism 30 comprises a magnetic trip mechanism 34, a low voltage trip mechanism 36, a first micro switch 32, a second micro switch 38, first driving force transmission mechanisms 31 and 33, and second driving force transmission mechanism 37 and 39.

The magnetic trip mechanism 34 is electrically connected to the OCR 10. Once receiving the first trip control signal from the OCR 10, the magnetic trip mechanism 34 provides a first mechanical driving force for triggering the switching mechanism such that the switching mechanism is driven to a 'TRIP' position.

The magnetic trip mechanism 34 comprises a first output lever 35*a* and a second output lever 35*b*.

Figure 7:
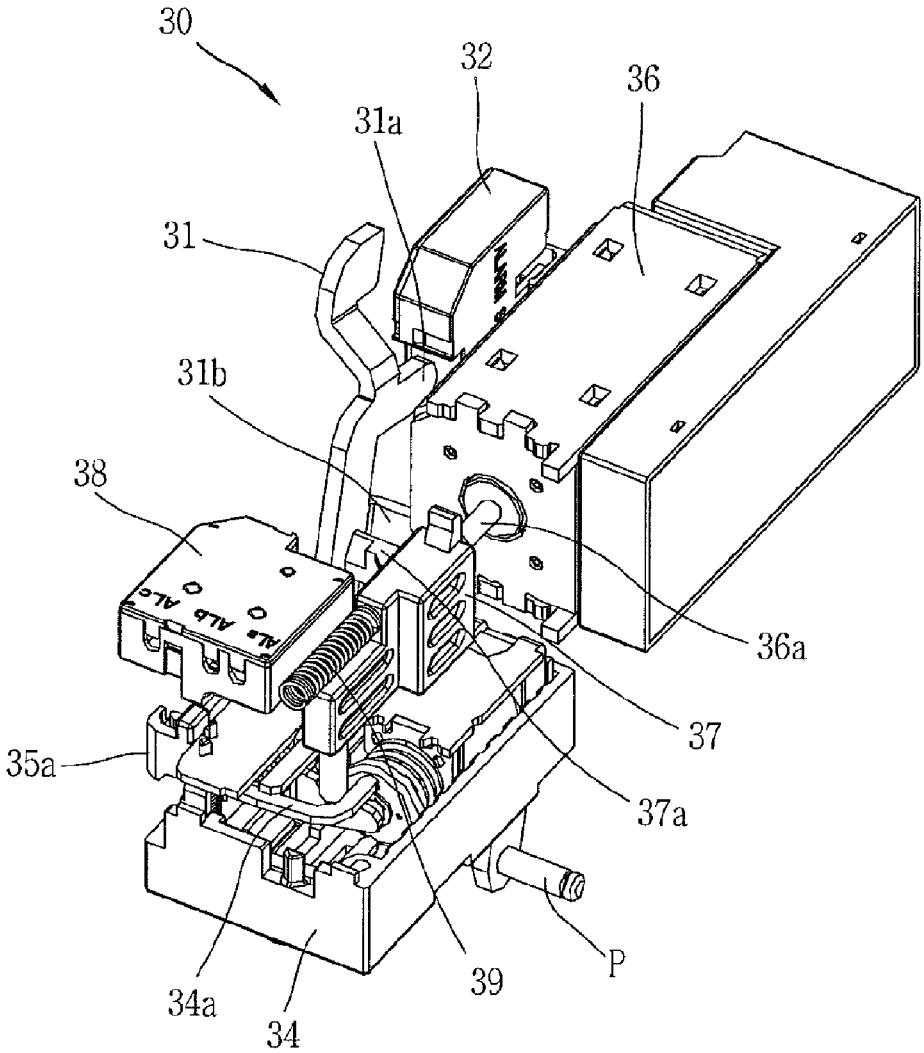
FIG. 7 is a perspective view of the trip cause indicating mechanism when the circuit breaker of FIG. 3 is in a tripped statue due to a fault current.
Figure 10:
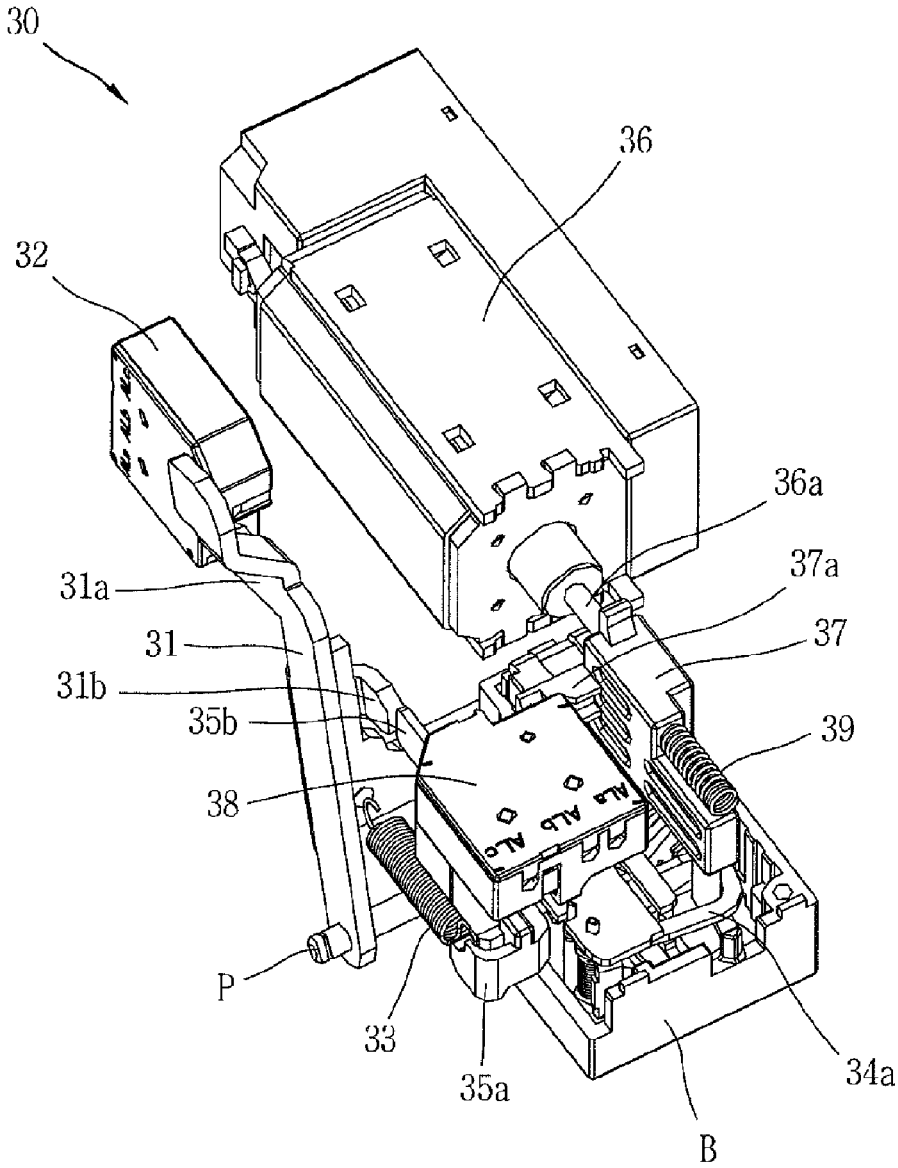
FIG. 10 is a perspective view of the trip cause indicating mechanism when the circuit breaker of FIG. 3 is in an under voltage tripped status.
Figure 11:
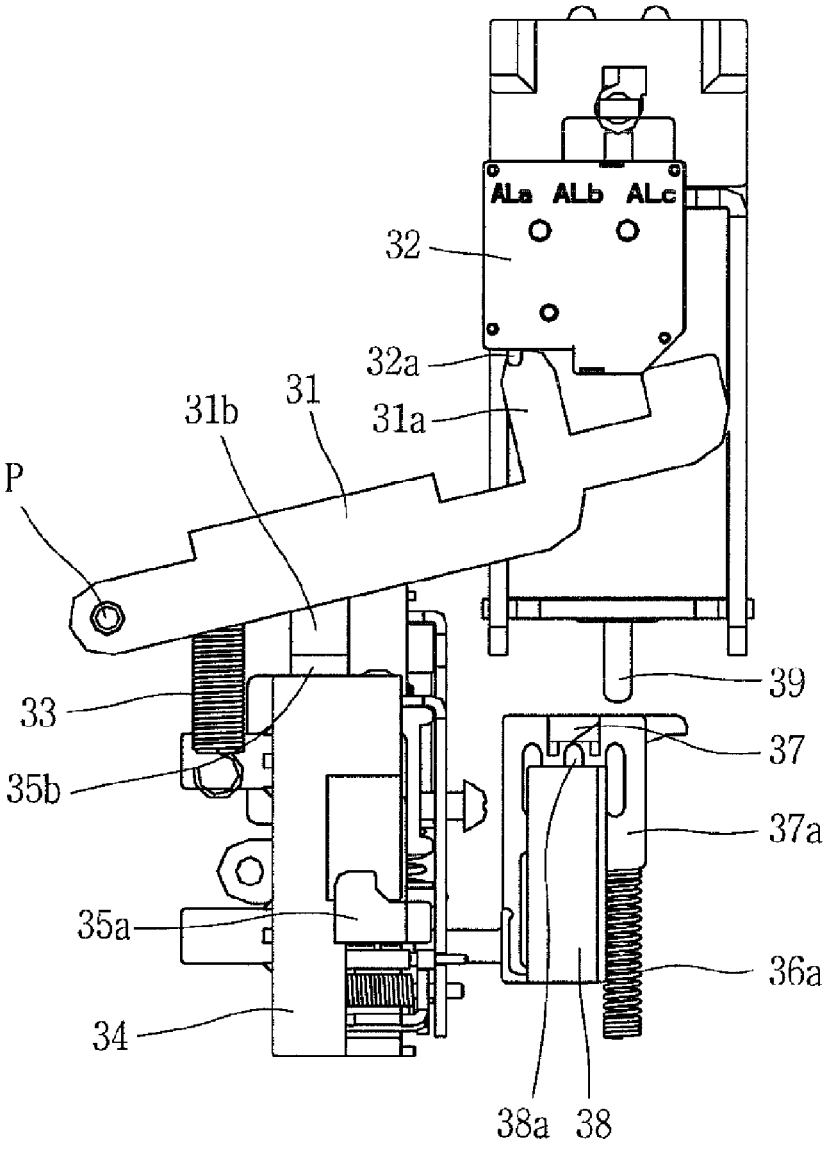
FIG. 11 is a left side sectional view of the trip cause indicating mechanism of FIG. 10.

As shown in FIGS. 7 and 10, the magnetic trip mechanism 34 is provided with an interlocking lever 34*a* driven by contacting a second lever 37 so as to interlock with the second lever 37 of the second driving force transmission mechanisms 37 and 39. The interlocking lever 34*a* is connected to the first output lever 35*a*.

The first output lever 35*a* provides a first mechanical driving force for triggering the switching mechanism such that the switching mechanism is driven to a 'TRIP' position.

The second output lever 35*b* provides the first mechanical driving force to the first driving force transmission mechanisms 31 and 33 such that the first mechanical driving force is transmitted to the first micro switch 32.

The low voltage trip mechanism 36 is electrically connected to the OCR 10. Once receiving the second trip control signal from the OCR 10, the low voltage trip mechanism 36 provides a second mechanical driving force for triggering the switching mechanism such that the switching mechanism is driven to a 'TRIP' position.

As shown in FIG. 7, the low voltage trip mechanism 36 comprises an output plunger 36*a* configured to output the second mechanical driving force.

The first micro switch 32 is configured to generate and output a first trip signal (refer to 'Sft' in FIG. 13) indicating that the circuit breaker has performed a trip operation due to the occurrence of an abnormal current on the circuit, by converting the first mechanical driving force received from the magnetic trip mechanism 34 into an electric signal. In order to receive the first mechanical driving force from the magnetic trip mechanism 34, the first micro switch 32 is provided with a first protrusion lever portion 32*a* protruding towards the first lever 31 and pressed when receiving the first mechanical driving force.

Figure 13:
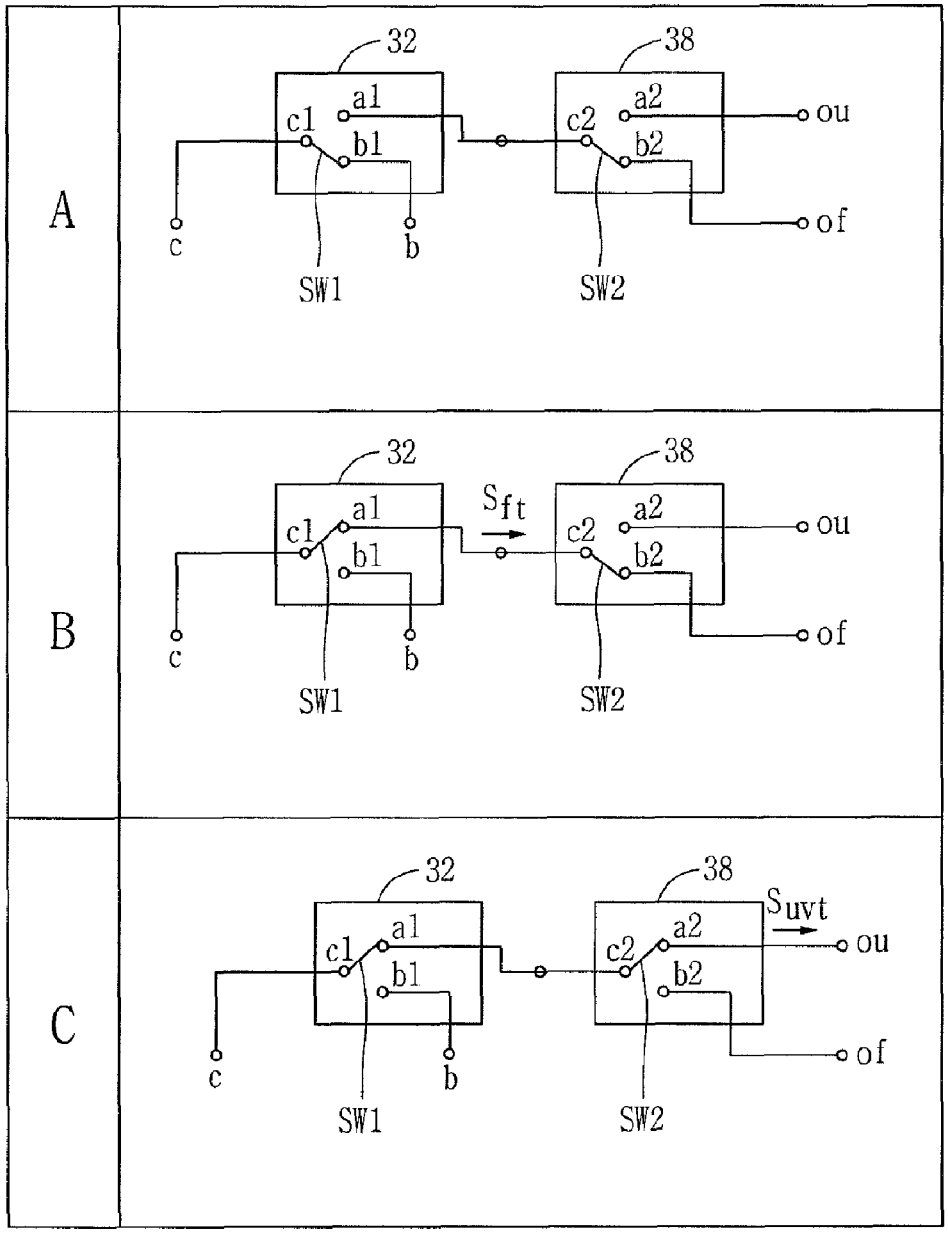
FIG. 13 is a circuit diagram showing a contact status between a first micro switch and a second micro switch which output trip signals when a trip operation due to a low voltage and a trip operation due to a fault current have occurred in the circuit breaker according to the present invention.

Referring to FIG. 13, the first micro switch 32 comprises a first common terminal (c1), a first switch (SW1), a first output terminal (b1) and a second output terminal (a1). The reference numeral 'c' in FIG. 13 is an external input terminal connected to the first common terminal (c1). For instance, the 'c' is a terminal connected to a direct current (DC) power source. The reference numeral 'b' in FIG. 13 is an external output terminal connected to the first output terminal (b1). The first common terminal (c1) is connected to the external input terminal (c) to receive a predetermined DC power source voltage from the external input terminal (c).

The first switch (SW1) is connected to the first protrusion lever portion 32*a* of the first micro switch 32 at an inner side of the first micro switch 32 so as to interlock with the first protrusion lever portion 32*a* protruding toward the outside.

The first switch (SW1) is provided with the first common terminal (c1), and is switchable to a position contacting the first output terminal (b1) or a position contacting the second output terminal (a1).

Once the magnetic trip mechanism 34 stops providing the first mechanical driving force as a normal current flows on the circuit of the circuit breaker, the first switch (SW1) comes in contact with the first output terminal (b1).

Once the magnetic trip mechanism 34 provides the first mechanical driving force, the first switch (SW1) comes in contact with the second output terminal (a1). That is, once the second output lever 35*b* of the magnetic trip mechanism 34 pushes a second extension portion 31*b* of the first lever 31 to counterclockwise rotate the first lever 31 as shown in FIG. 10, the first extension portion 31*a* of the first lever 31 presses the first protrusion lever portion 32*a* of the first micro switch 32. Here, the first switch (SW1) connected to the first protrusion lever portion 32*a* inside the first micro switch 32 is switched to a position contacting the second output terminal (a1).

The second micro switch 38 is configured to generate and output a second trip signal ('Suvt') indicating that the circuit breaker has performed a trip operation due to the occurrence of a low voltage on the circuit, by converting the second mechanical driving force received from the low voltage trip mechanism 36 into an electric signal. In order to receive the second mechanical driving force from the low voltage trip mechanism 36, the second micro switch 38 is provided with a second protrusion lever portion 38*a* protruding towards the outside and pressed when receiving the second mechanical driving force.

Referring to FIG. 13, the second micro switch 38 comprises a second common terminal (c2), a second switch (SW2), a third output terminal (b2) and a fourth output terminal (a2).

The reference numeral 'ou' in FIG. 13 is an external output terminal connected to the fourth common terminal (a2), which is an output terminal which generates and output a second trip signal ('Suvt') indicating that the circuit breaker has performed a trip operation due to the occurrence of a low voltage on the circuit.

The reference numeral 'of' in FIG. 13 is an external output terminal connected to the third common terminal (b2), which is an output terminal which generates and output a first trip signal ('Sft') indicating that the circuit breaker has performed a trip operation due to the occurrence of a fault current on the circuit.

The second switch (SW2) is provided with the second common terminal (c2), and is switchable to a position contacting the fourth output terminal (a2) or a position contacting the third output terminal (b2).

The second switch (SW2) is connected to the second protrusion lever portion 38*a* of the second micro switch 38 at an inner side of the second micro switch 38 so as to interlock with the second protrusion lever portion 38*a* protruding toward the outside.

Referring to FIG. 10, when the second protrusion lever portion 38*a* is pressed by an extension operation portion 37*a* of the second lever 37 as an output plunger 36*a* of the low voltage trip mechanism 36 pushes the second lever 37, the second switch (SW2) is switched to a position contacting the fourth output terminal (a2).

When the low voltage trip mechanism 36 stops providing the second mechanical driving force, the second switch (SW2) comes in contact with the third output terminal (b2).

When the low voltage trip mechanism 36 provides the second mechanical driving force since the circuit to which the circuit breaker is connected is in an under voltage status, the second switch (SW2) comes in contact with the fourth output terminal (a2).

When the low voltage trip mechanism 36 stops providing the second mechanical driving force, the second switch comes in contact with the third output terminal (b2).

When the low voltage trip mechanism 36 provides the second mechanical driving force, the second switch comes in contact with the fourth output terminal (a2).

The first driving force transmission mechanisms 31 and 33 are connected between the first micro switch 32 and the magnetic trip mechanism 34, and transmit the first mechanical driving force from the magnetic trip mechanism 34 to the first micro switch 32.

The first driving force transmission mechanism comprises a first lever 31 and a first return spring 33.

As shown in FIGS. 4 to 12, the first lever 31 is rotatable to a first position contacting the first micro switch 32 such that the first mechanical driving force from the magnetic trip mechanism 34 is transmitted to the first micro switch 32, and a second position separated from the first micro switch 32. The first lever 31 is configured as a bar type plate having a predetermined thickness and a narrow width, and a lower end of the first lever 31 is rotatably supported by a shaft pin (P). As shown in FIG. 7, the first lever 31 is provided with a first extension portion 31*a* disposed at an upper side and extending towards the first micro switch 32, and a second extension portion 31*b* disposed at an intermediate side and extending toward the second output lever (refer to 35*b* of FIGS. 8 and 9) of the magnetic trip mechanism 34 thus to contact the second output lever 35*b*.

Figure 5:
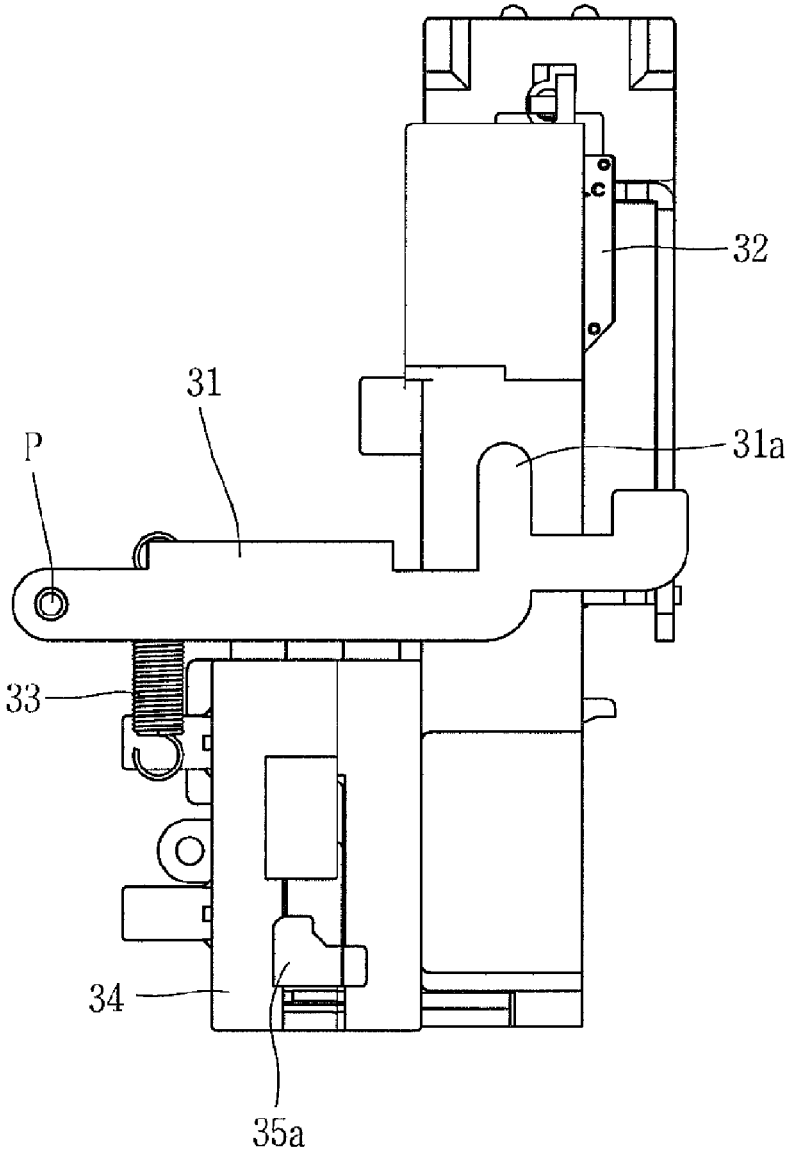
FIG. 5 is a left side view of a trip cause indicating mechanism of FIG. 4.
Figure 8:
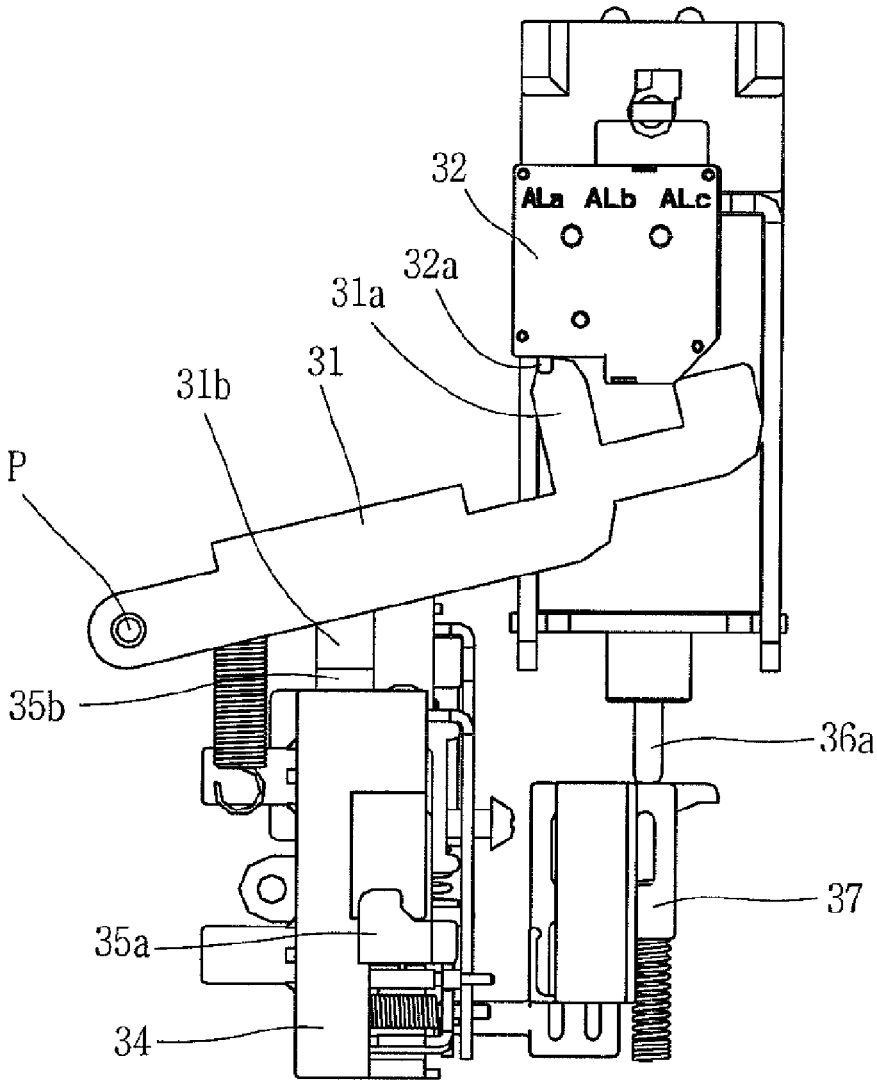
FIG. 8 is a left side view of the trip cause indicating mechanism of FIG. 7.
Figure 9:
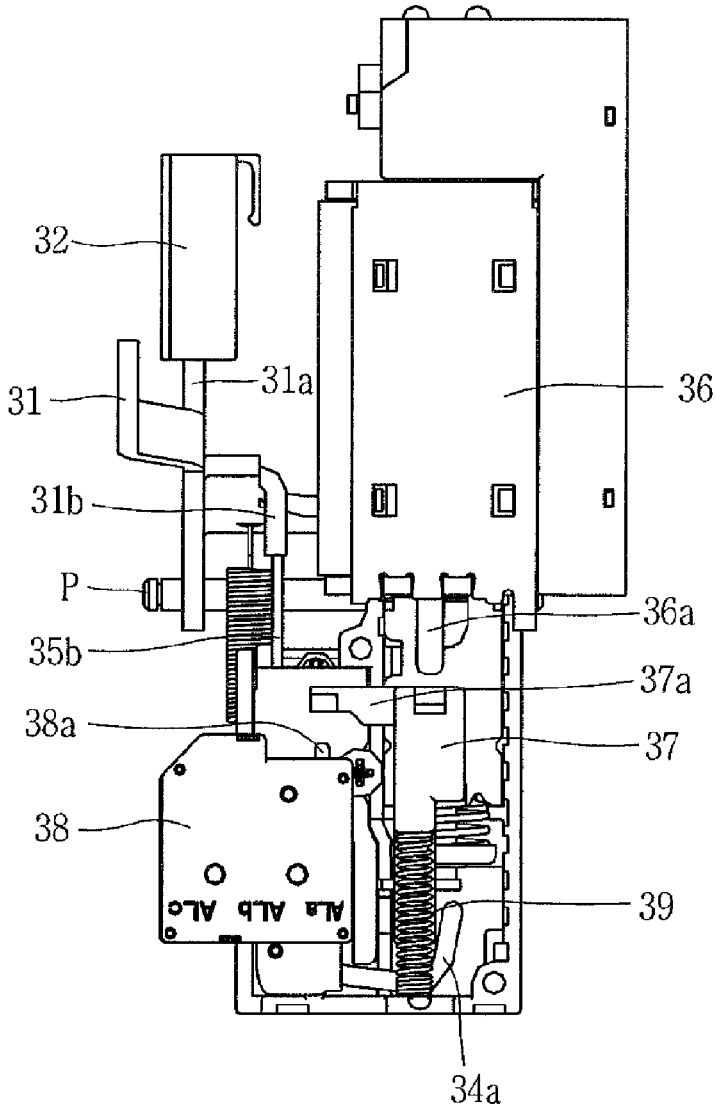
FIG. 9 is a partially-cut away planar view of the trip cause indicating mechanism of FIG. 7.

Referring to FIGS. 5, 8 and 9, the first return spring 33 has one end supported by the first lever 31, and another end supported by a spring supporting portion downwardly extending from a lower part of the magnetic trip mechanism 34. Once the first mechanical driving force from the magnetic trip mechanism 34 has disappeared, the first return spring 33 elastically biases the first lever 31 such that the first lever 31 is moved to the second position from the first position.

The second driving force transmission mechanisms 37 and 39 are connected between the second micro switch 38 and the low voltage trip mechanism 36, and transmit the second mechanical driving force from the low voltage trip mechanism 36 to the second micro switch 38.

The second driving force transmission mechanism 37 and 39 comprises a second lever 37 and a second return spring 39.

The second lever 37 has a first position contacting the second micro switch such that the second mechanical driving force outputted from the output plunger 36*a* of the low voltage trip mechanism 36 is transmitted to the second micro switch 38, and a second position separated from the second micro switch when the second mechanical driving force has disappeared. The second lever 37 is configured as a rectangular block formed of metal or synthetic resin, and is provided with an extension operation portion 37*a*. The extension operation portion 37*a* is extending from one side surface of the second lever 37, to a position facing the protrusion lever portion 38*a* of the second micro switch 38.

In the FIGS. 7 and 10, the second lever 37 is provided with a lower extension portion (not shown) contactable to the interlocking lever 34*a* of the magnetic trip mechanism 34 and driven by pushing the interlocking lever 34*a*.

When the second mechanical driving force has disappeared, the second return spring 39 elastically biases the second lever 37 such that the second lever 37 is moved to the second position.

The operation to indicate a trip cause by the circuit breaker according to the present invention will be explained with reference to FIG. 13 mainly, and with reference to FIGS. 3 to 12 supplementarily.

The "A" row in FIG. 13 shows an electric status of a circuit breaker when a circuit to which the circuit breaker according to the present invention has been connected is in a normal current status and a normal voltage status. Under this status, a mechanical status of the trip cause indicating mechanism 300 of the circuit breaker according to the present invention is same as the status shown in FIGS. 4 to 6.

Figure 6:
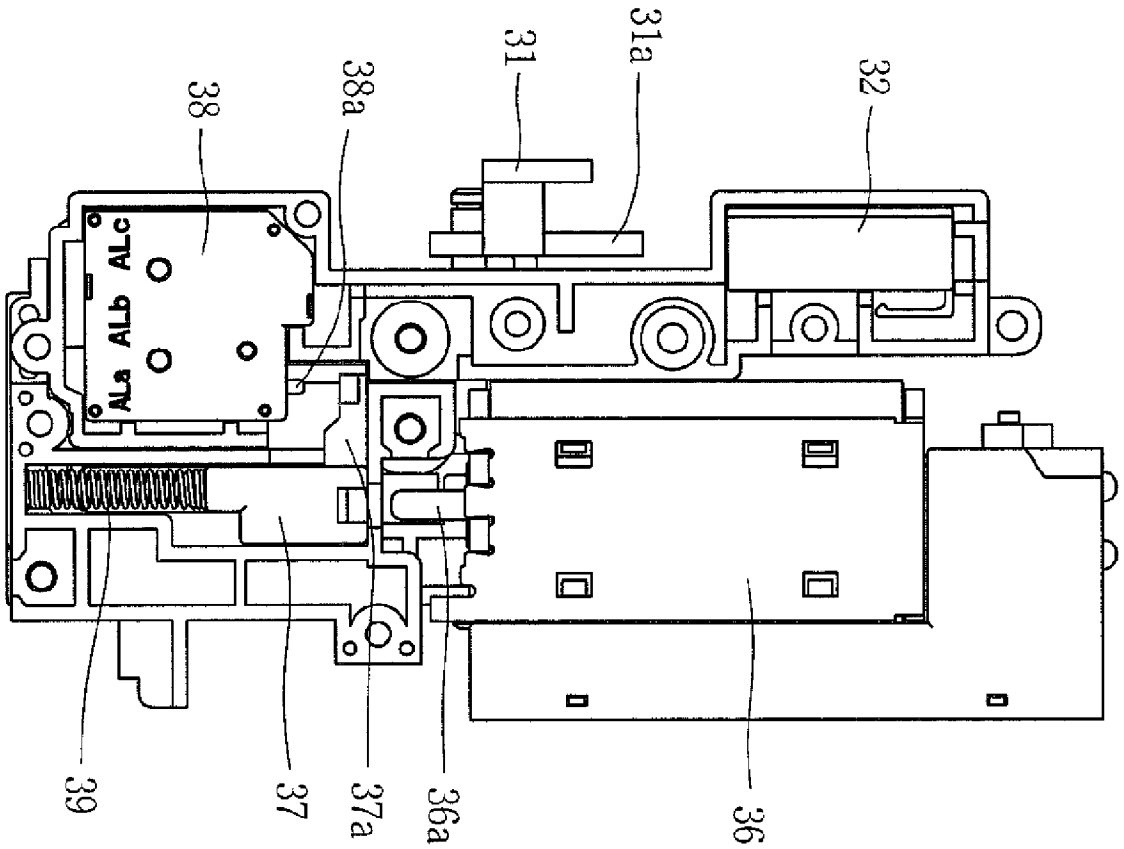
FIG. 6 is a planar view of the trip cause indicating mechanism of the circuit breaker according to the present invention.

The mechanical status of the trip cause indicating mechanism 300 of the circuit breaker according to the present invention will be described as followed referring to FIGS. 4 to 6.

When the circuit to which the circuit breaker according to the present invention has been connected is in a normal current status and a normal voltage status, the OCR 10 of FIG. 3 does not generate the first trip control signal. Since the first trip control signal is not generated from the OCR 10, the first output lever (refer to 35*a* of FIG. 10) of the magnetic trip mechanism 34 is not moved. As a result, there is not provided the first mechanical driving force for triggering the switching mechanism such that the switching mechanism is driven to a trip position.

The second output lever 35*b* of the magnetic trip mechanism 34 does not perform an operation to provide the first mechanical driving force to the first driving force transmission mechanisms 31 and 33 such that the first mechanical driving force is transmitted to the first micro switch 32. As a result, as shown in FIGS. 4 to 6, the first lever is stopped with an upright status. Accordingly, the first extension portion 31*a* of the first lever 31 is located at a position separated from the first protrusion lever portion 32*a* of the first micro switch 32. As a result, the first switch (SW1) of the first micro switch 32 connected to the first protrusion lever portion 32*a* comes in contact with the first output terminal (b1) as shown in 'A' of FIG. 13.

When the circuit is in a normal voltage status, the OCR 10 of FIG. 3 does not generate the second trip control signal. Since the second trip control signal is not generated from the OCR 10, the output plunger 36*a* of the low voltage trip mechanism 36 is not forwardly moved. As a result, the second mechanical driving force is not provided.

Since the second mechanical driving force is not provided, the second lever 37 and the extension operation portion 37*a* of the second lever 37 are stopped. Accordingly, the extension operation portion 37*a* does not push the protrusion lever portion 38*a* of the second micro switch 38. As a result, the second switch (SW2) of the second micro switch 38 connected to the protrusion lever portion 38*a* comes in contact with the third output terminal (b2) as shown in 'A' of FIG. 13.

Once a fault current such as an electrical shortage or an over current has occurred on the circuit which is in a normal status, the OCR 10 shown in FIG. 3 detects the occurrence of the fault current on the circuit and generates a first trip control signal.

In response to the first trip control signal received from the OCR 10, the magnetic trip mechanism 34 moves the first output lever (refer to 35*a* of FIG. 10) to provide a first mechanical driving force. By this first mechanical driving force, the switching mechanism is triggered to perform a trip operation. As a result, the circuit connected to the circuit breaker according to the present invention is broken.

The magnetic trip mechanism 34 provides the first mechanical driving force to the first driving force transmission mechanisms 31 and 33 through the second output lever 35*b* such that the first mechanical driving force is transmitted to the first micro switch 32.

As shown in FIGS. 7 to 9, the first lever 31 is counterclockwise rotated centering around a shaft pin (P). Accordingly, the first extension portion 31*a* of the first lever 31 is located at a position contacting and pushing the first protrusion lever portion 32*a* of the first micro switch 32. As a result, the first switch (SW1) of the first micro switch 32 connected to the first protrusion lever portion 32*a* is switched to a position contacting the second output terminal (a1) as shown in the circuit diagram of row 'B' of FIG. 13.

Accordingly, a DC power source voltage (not shown) connected to the first common terminal (c1) of the first micro switch 32 through the external input terminal (c) is transmitted to the second micro switch 38 as a first trip indication signal (Sft) indicating that the circuit breaker has performed a trip operation due to the occurrence of a fault current on the circuit.

When the circuit is not in an under voltage status, the OCR 10 of FIG. 3 does not generate the second trip control signal. Since the second trip control signal is not generated from the OCR 10, the output plunger 36*a* of the low voltage trip mechanism 36 is not forwardly moved. As a result, the second mechanical driving force is not provided.

Since the second mechanical driving force is not provided, the second lever 37 and the extension operation portion 37*a* of the second lever 37 are stopped. Accordingly, the extension operation portion 37*a* does not push the protrusion lever portion 38*a* of the second micro switch 38. As a result, the second switch (SW2) of the second micro switch 38 connected to the protrusion lever portion 38*a* comes in contact with the third output terminal (b2) as shown in 'A' circuit diagram or 'B' circuit diagram of FIG. 13.

As shown in 'B' of FIG. 13, the first trip indicating signal (Sft) is outputted through the second switch (SW2), the third output terminal (b2) and the output terminal (of). The first trip indicating signal (Sft) indicates that the circuit breaker has performed a trip operation due to the occurrence of a fault current on the circuit. This first trip indicating signal (Sft) may be used to drive a display unit installed at the circuit breaker, and may indicate a corresponding trip cause. Also, the first trip indicating signal (Sft) may be transmitted to a monitoring station located at a remote position and including a personal computer, etc., through a communication network (not shown) such that a trip cause of the circuit breaker is displayed. This may allow a manager of an electric power circuit to precisely recognize a trip cause, and to rapidly cope with the trip cause.

Once a user manually rotates a handle of the switching mechanism to a reset position ('OFF' position) after the circuit breaker has performed a trip operation, the magnetic trip mechanism 34 is reset and the second output lever 35*b* of the magnetic trip mechanism 34 is backwardly moved. At the same time, the first lever 31 which is pressing the first protrusion lever portion 32*a* of the first micro switch 32 returns to an initial position by the first return spring 33.

The first switch (SW1) of the micro switch 32 return to a position contacting the first output terminal (b1) as shown in 'A' of FIG. 13. Accordingly, the trip cause indicating mechanism of the present invention is in an electric status of 'A' shown in FIG. 13.

A voltage applied to the circuit breaker according to the present invention is lower than a predetermined reference voltage, the over current trip relay 10 of FIG. 3 generates and outputs the second trip control signal. In response to the second trip control signal from the OCR 10, the output plunger 36*a* of the low voltage trip mechanism 36 is forwardly moved to provide a second mechanical driving force.

Figure 12:
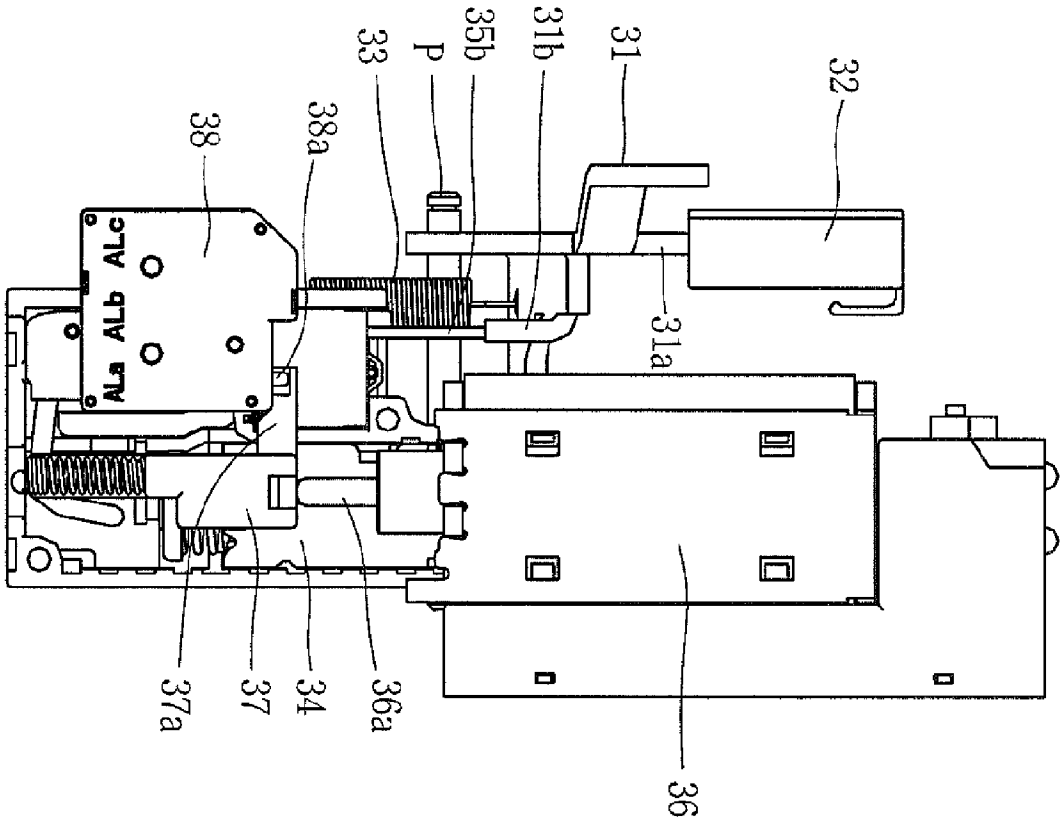
FIG. 12 is a partially-cut away planar view of the trip cause indicating mechanism of FIG. 10.

Since the output plunger 36*a* of the low voltage trip mechanism 36 is forwardly moved to perform a pushing operation by the second mechanical driving force, the second lever 37 and the extension operation portion 37*a* of the second lever 37 are forwardly moved as shown in FIG. 12. Accordingly, the extension operation portion 37*a* pushes the protrusion lever portion 38*a* of the second micro switch 38. As a result, the second switch (SW2) of the second micro switch 38 connected to the protrusion lever portion 38*a* comes in contact with the fourth output terminal (a2) as shown in 'C' of FIG. 13. Here, the interlocking lever 34*a* of the magnetic trip mechanism 34 pushed by the lower extension portion of the first output lever 35*a* is driven, and the first output lever (refer to 35*a* of FIG. 10) connected to the interlocking lever 34*a* is moved to provide a first mechanical driving force. By the first mechanical driving force, the switching mechanism is triggered to perform a trip operation. As a result, the circuit connected to the circuit breaker according to the present invention is broken.

Here, a DC power source voltage (not shown) connected to the first common terminal (c1) of the first micro switch 32 through the external input terminal (c) is transmitted to the second micro switch 38 as a second trip indicating signal (Suvt) indicating that the circuit breaker has performed a trip operation due to the occurrence of a low voltage on the circuit. The second trip indicating signal (Suvt) is output through the second switch (SW2), the fourth output terminal (a2) and the output terminal (ou) as shown in 'C' of FIG. 13. By the second trip indicating signal (Suvt), it is indicated that the circuit breaker has performed a trip operation due to the occurrence of a low voltage on the circuit. This second trip indicating signal (Suvt) may be used to drive a display unit installed at the circuit breaker, and may indicate a corresponding trip cause. Also, the second trip indicating signal (Suvt) may be transmitted to a monitoring station located at a remote position and including a personal computer, etc., through a communication network (not shown) such that a trip cause of the circuit breaker is displayed. This may allow a manager of a power circuit to precisely recognize a trip cause, and to rapidly cope with the trip cause.

Once the OCR 10 stops transmitting the second trip control signal to the low voltage trip mechanism 36 after the low voltage trip mechanism 36 has performed a trip operation, a core and a coil (not shown) inside the low voltage trip mechanism 36 is demagnetized to be backwardly moved by an elastic force of a return spring (not shown) inside the low voltage trip mechanism 36. As a result, the second lever 37 and the extension operation portion 37*a* of the second lever 37 are backwardly moved by an elastic force of the return spring 39, and the extension operation portion 37*a* is separated from the protrusion lever portion 38*a* of the second micro switch 38. Accordingly, the second switch (SW2) of the second micro switch 38 connected to the protrusion lever portion 38*a* is switched to an initial position contacting the third output terminal (b2) as shown in 'A' or 'B' of FIG. 13.

As aforementioned, the circuit breaker according to the present invention outputs a signal indicating whether a trip cause results from a fault current such as an over current and an electrical shortage, or an under voltage on the circuit. This may allow a user of the circuit breaker or a manager of an electric power circuit to precisely recognize a trip cause, and to rapidly cope with the trip cause.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A circuit breaker having a switching mechanism having an 'OFF' position for manually breaking a circuit, an 'ON' position for manually closing the circuit, and a 'TRIP' position for automatically breaking the circuit, the circuit breaker comprising:

an over current relay configured to generate and output a first trip control signal when an abnormal current on the circuit has been detected, and to generate and output a second trip control signal when a voltage applied to the circuit has been detected as a voltage less than a predetermined reference voltage;

a magnetic trip mechanism electrically connected to the over current relay, and configured to provide a first mechanical driving force when receiving the first trip control signal from the over current relay;

a low voltage trip mechanism electrically connected to the over current relay, and configured to provide a second mechanical driving force when receiving the second trip control signal from the over current relay;

a first micro switch configured to generate and output a first trip indicating signal indicating that the circuit breaker has performed a trip operation due to the occurrence of an abnormal current on the circuit, by converting the first mechanical driving force received from the magnetic trip mechanism into an electric signal;

a second micro switch configured to generate and output a second trip indicating signal indicating that the circuit breaker has performed a trip operation due to the occurrence of a low voltage on the circuit, by converting the second mechanical driving force received from the low voltage trip mechanism into an electric signal;

a first driving force transmission mechanism connected between the first micro switch and the magnetic trip mechanism, and configured to transmit the first mechanical driving force from the magnetic trip mechanism to the first micro switch; and a second driving force transmission mechanism connected between the second micro switch and the low voltage trip mechanism, and configured to transmit the second mechanical driving force from the low voltage trip mechanism to the second micro switch, wherein the low voltage trip mechanism comprises an output plunger configured to output the second mechanical driving force, and wherein the second driving force transmission mechanism comprises a second lever movable to a first position contacting the second micro switch such that the second mechanical driving force output from the output plunger is transmitted to the second micro switch, and a second position separated from the second micro switch when the second mechanical driving force has disappeared.

2. The circuit breaker of claim 1, wherein the magnetic trip mechanism comprises:

a first output lever configured to a first mechanical driving force such that the switching mechanism is triggered to be operated on a trip position; and a second output lever configured to provide the first mechanical driving force to the first driving force transmission mechanism such that the first mechanical driving force is transmitted to the first micro switch.

3. The circuit breaker of claim 1, wherein the first driving force transmission mechanism comprises:

a first lever rotatable to a first position contacting the first micro switch such that the first mechanical driving force from the magnetic trip mechanism is transmitted to the first micro switch, and a second position separated from the first micro switch; and a first return spring configured to elastically bias the first lever such that the first lever is moved to the second position from the first position when the first mechanical driving force from the magnetic trip mechanism has disappeared.

4. The circuit breaker of claim 1, wherein the second driving force transmission mechanism further comprises a second return spring configured to elastically bias the second lever such that the second lever is moved to the second position from the first position when the second mechanical driving force has disappeared.

5. The circuit breaker of claim 1, wherein the first micro switch comprises:

a first common terminal;

a first switch connected to the first common terminal;

a first output terminal to which the first switch contacts when the magnetic trip mechanism stops providing the first mechanical driving force as a normal current flows on the circuit of the circuit breaker; and a second output terminal to which the first switch contacts when the magnetic trip mechanism provides the first mechanical driving force.

6. The circuit breaker of claim 1, wherein the second micro switch comprises:

a second common terminal;

a second switch connected to the second common terminal;

a third output terminal to which the second switch contacts when the low voltage magnetic trip mechanism stops providing the second mechanical driving force; and a fourth output terminal to which the second switch contacts when the low voltage trip mechanism provides the second mechanical driving force.

* * * * *